US006428291B1

(12) United States Patent
Baerlin et al.

(10) Patent No.: US 6,428,291 B1
(45) Date of Patent: Aug. 6, 2002

(54) RECIPROCATING PUMP FOR A HIGH PRESSURE CLEANING APPLIANCE

(75) Inventors: Thomas Baerlin, Waiblingen; Robert Nathan, Backnang; Joachim Daiss, Auenwald, all of (DE)

(73) Assignee: Alfred Kaercher GmbH & Co., Winnenden (DE)

( * ) Notice: Subject to any disclaimer, the term of this patent is extended or adjusted under 35 U.S.C. 154(b) by 0 days.

(21) Appl. No.: 09/615,401

(22) Filed: Jul. 13, 2000

Related U.S. Application Data

(63) Continuation of application No. PCT/EP98/07791, filed on Dec. 1, 1998.

(30) Foreign Application Priority Data

Apr. 14, 1998 (DE) ..... 198 01 146

(51) Int. Cl.[7] ..... F04B 39/10; F04B 39/00

(52) U.S. Cl. ..... 417/569; 417/454; 417/307; 417/440; 417/470

(58) Field of Search ..... 417/569, 454, 417/307, 440, 470

(56) References Cited

U.S. PATENT DOCUMENTS

| | | | | |
|---|---|---|---|---|
| 5,131,818 A | * | 7/1992 | Wittkop | 417/273 |
| 5,622,479 A | * | 4/1997 | Earle | 417/231 |
| 5,688,113 A | * | 11/1997 | Bareiss et al. | 417/549 |

FOREIGN PATENT DOCUMENTS

| | | | |
|---|---|---|---|
| DE | 39 28 006 | * | 3/1990 |
| DE | 296 03 822 | * | 6/1996 |
| DE | 297 01 555 | * | 4/1997 |
| DE | 195 48 498 | * | 7/1997 |
| EP | 0 503 345 | * | 9/1992 |
| EP | 0 667 270 | * | 8/1995 |
| EP | 0 668 113 | * | 8/1995 |

* cited by examiner

*Primary Examiner*—Charles G. Freay
*Assistant Examiner*—Michael K. Gray
(74) *Attorney, Agent, or Firm*—Barry R. Lipstiz

(57) ABSTRACT

In the case of a reciprocating pump for a high pressure cleaning appliance including a pump housing in which there is disposed at least one pumping chamber having an inlet valve, an outlet valve and a reciprocating piston that projects thereinto in sealed manner, said pump housing comprising a pump block and a pump head which abut closely together at a interface, wherein the pumping chambers and/or the connecting conduits penetrate the interface in sealed manner and, in the region of the interface, accommodate inserts that are insertable into the pumping chambers and/or the connecting conduits from the interface, said inserts being fixed between the pump block and the pump head when in their inserted position, it is proposed that the whole construction be simplified by making the inserts themselves and the region of the pumping chambers and the connecting conduits in which the inserts are accommodated out of a thermally softenable synthetic material, and by connecting the inserts to the wall of the pumping chamber or the connecting conduit in which they are accommodated by means of a welded joint.

18 Claims, 4 Drawing Sheets

RECIPROCATING PUMP FOR A HIGH PRESSURE CLEANING APPLIANCE

Figure 1:
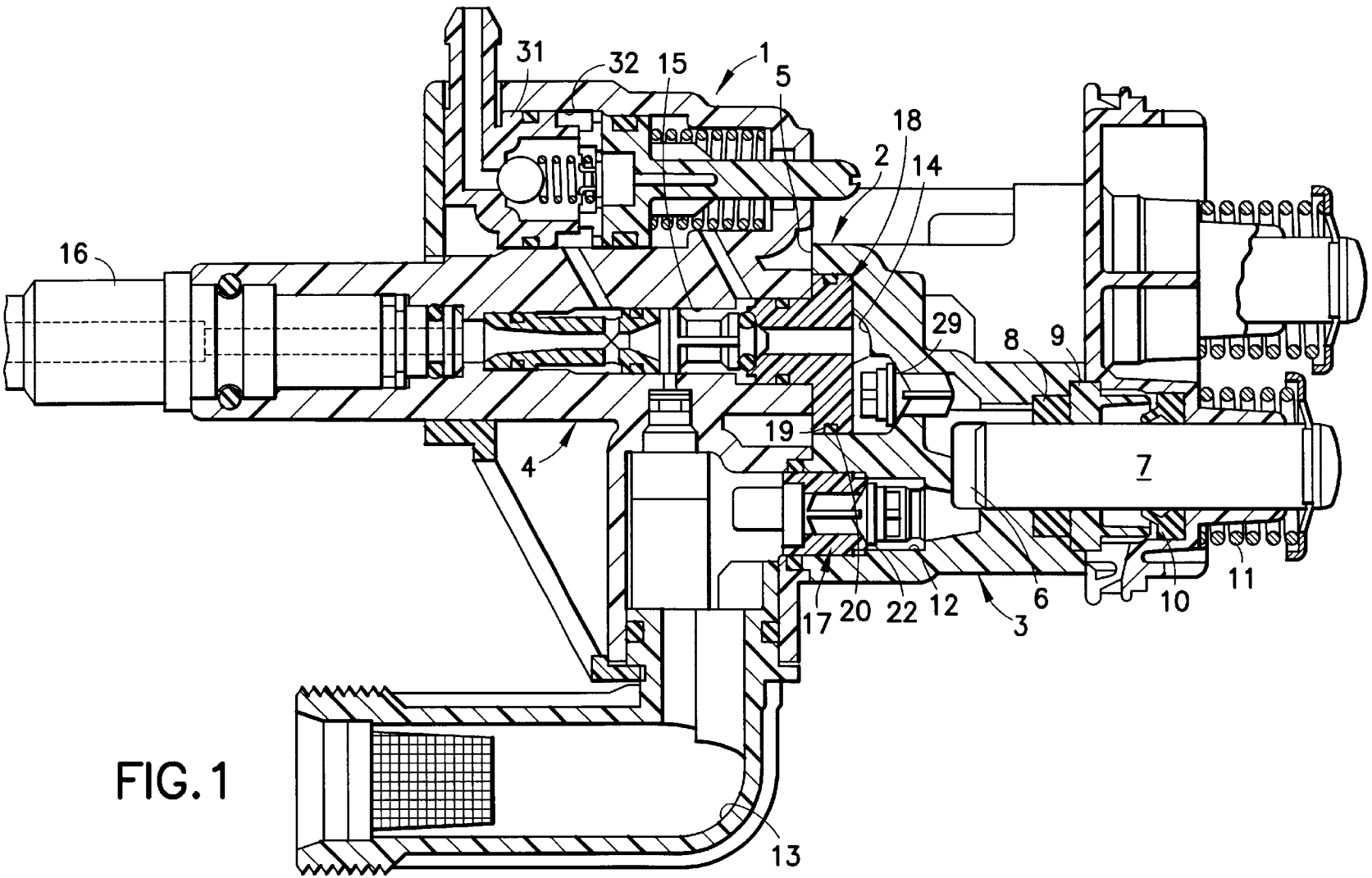

The present invention continuation of the subject matter disclosed in international application No. PCT/EP98/07791 of Dec. 1, 1998, the entire specification of which is incorporated herein by reference.

The invention relates to a reciprocating pump for a high pressure cleaning appliance including a pump housing in which there is disposed at least one pumping chamber having an inlet valve, an outlet valve and a reciprocating piston that projects thereinto in sealed manner, said pump housing comprising a pump block and a pump head which abut closely together at a interface, wherein the pumping chambers and/or the connecting conduits penetrate the interface in sealed manner and, in the region of the interface, accommodate inserts that are insertable into the pumping chambers and/or the connecting conduits from the interface, said inserts being fixed between the pump block and the pump head when in their inserted position.

In the endeavour to make reciprocating pumps for high pressure cleaning appliances ever more compact and lighter, one has repeatedly turned to the idea of making the pump housing out of a synthetic material. However, when constructing high pressure pumps, difficulties have arisen as a result of the very high forces that can occur between the pump block and the pump head in the region of the interface. These are caused by inserts which are inserted into the pumping chambers or the connecting conduits and then clamped between the pump head and the pump block in the region of the interface. Large forces can become effective on these inserts, in the axial direction, due to the high pressure of the medium being pumped, and, in the case of conventionally constructed pumps, these forces have to be accommodated by clamping the pump head and the pump block together. It is thereby necessary to take extensive precautions so as to prevent the pump housing from "breathing" due to the pressure pulsations occurring at the pump rate, for example, the pump heads have to be coated with metal caps.

The object of the invention is to design a reciprocating pump of the kind mentioned in the first part of the main claim in such a way that forces of this nature are avoided in the abutment region of the pump head and the pump block.

This object is achieved in the case of a reciprocating pump of the type mentioned hereinabove in that the inserts themselves and the region of the pumping chambers and the connecting conduits in which the inserts are accommodated consist of a thermally softenable synthetic material, and in that the inserts are connected to the wall of the pumping chamber or the connecting conduit in which they are accommodated by means of a welded joint.

Thus, in contrast to the known constructions, the inserts are not fixed in the pumping chambers and the connecting conduits by clamping them between the pump head and the pump block, but rather, by permanently welding the inserts to the wall of the pump head or the pump block surrounding them.

Furthermore, provision may be made for the pump block and the pump head to consist of a softenable synthetic material at least in the region of the interface and for them to be connected together at the interface by a welded joint. Expensive screw-type fastenings for connecting them together thereby become redundant since the welded bond itself is sufficient to permanently connect the pump head and the pump block together, especially in view of the fact that the forces in the abutment region between the pump head and the pump block are reduced as a result of the inserts being fixed in the connecting conduits and/or the pumping chambers by means of a welded joint.

In another preferred embodiment, provision may be made for the pump housing to comprise a connector used for drawing-off a chemical and incorporating a valve insert which is inserted in a seating of the pump housing, and for the valve insert and the seating to consist of a softenable synthetic material at least in their contact region and for them to be connected together in this contact region by a welded joint. Thus, in this design, the fixing of a valve insert in a seating by a process of welding softenable synthetic materials is not only carried out in the region of the interface, but can also be done for other valve inserts, in this case, a valve insert for drawing-off a chemical .

In accordance with preferred embodiments, the welding of the joint can be executed in various manners, for example, the welded joint may be an ultrasonically welded joint or a butt-welded joint or may be produced by a vibratory process or a frictional process.

In the case of an ultrasonically welded joint, the two parts to be welded are moved against each other at a high frequency but low amplitude, for example, they are rotated against each other about the longitudinal axis of the pumping chamber or the connecting conduit and, as a result of this movement, the heat generated at the point of contact is so great that the synthetic material of both the surrounding wall and the insert melts. The melted synthetic materials intermix and thereby form a dependable welded connection between the insert and the surrounding wall, after they have cooled and thereby consolidated. This welded connection not only has the advantage that the inserts are permanently fixed in their inserted positions in the pumping chamber or the connecting conduit but, in addition, all of the axial forces are accommodated by the welded connection so that these axial forces do not have to be transferred between the pump head and the pump block in the region of the interface, which could lead to the pump housing "breathing" when in operation. Finally, there is provided optimum sealing between the insert and the surrounding wall so that additional sealing means can be dispensed with in this region, for example, there is no longer a need to provide O-ring seals at the outer periphery of the inserts.

In the case of a vibratory welding process, the two parts to be welded are moved against each other at a frequency which is substantially smaller vis a vis that used in ultrasonic welding, this being done by vibrating one of the two parts that are to be welded against the other one. Due to the relative movement and the friction thereby arising between the two parts being welded, heat is generated which leads to a softening of the materials that are to be welded.

One proceeds in a similar manner in the case of the frictional welding process, whereby the two parts being welded are heated up and melt together due to a more or less continuous movement and the frictional heat resulting therefrom.

Finally, in the case of a butt-welded joint, thin heating elements are inserted in the region of the contact faces of the two parts that are to be connected together, these elements being removed after the adjacent materials have melted. The melted materials can then intermix internally and thereby form the welded joint. In the case of an insert that is inserted in a pumping chamber or a boring, the thin heating elements could take the form of a rotary disk shutter for example, these being drawn radially inwardly towards the interior of the insert following the heating of the material whereby they can be withdrawn completely from the insert after the welded connection has been formed.

It is propitious for the insert to be in the form of a sleeve.

In a preferred embodiment, provision may be made for the rim of the sleeve remote from the interface to be in the form of a sealing seat for a valve body. Such a valve body exerts large axial forces on its sealing seat and these forces can be led from the insert directly into the surrounding wall via the ultrasonically welded joint without these forces being conveyed to the respective other part of the pump housing.

It is also propitious, if the sleeve is in the form of a sealing sleeve which projects beyond the interface. The projecting part can then be inserted into corresponding parts of the pumping chambers or connecting conduits in the respective other part of the pump housing and hereby produce a sealing effect in the region of the interface.

In another preferred embodiment, provision is made for the insert to serve as a support for a spring which pushes a valve body against a sealing seat.

Particularly propitious is a design in which provision is made for the insert and the pumping chamber or the connecting conduit accommodating it to have annular shoulders which abut one another when the insert is inserted and which, following the thermal softening of their material by the ultrasonic welding process, become deformed and bond together as the insert is inserted further.

Thus, in such a design, the annular shoulders abut one another in the direction of insertion and these annular shoulders are then heated up in their abutment region due to the micro-movement of the two parts produced by the ultrasonic welding process so that the material in this region melts and intermixes. By pressing on the insert, one will thereby obtain an optimal intermingling of the materials and hence a dependable welded connection which extends axially over practically the whole insertion depth of the insert beginning at the first abutment of the respective annular shoulders of the insert and the pumping chambers or connecting conduit.

It is also possible to work annular grooves into the mutually facing wall sections of the insert and the pumping chambers or the connecting conduits, whereby these annular grooves then serve to accommodate the melted material and, in addition, lead to a solid interconnection of the materials of the insert and the surrounding wall.

Figure 2:
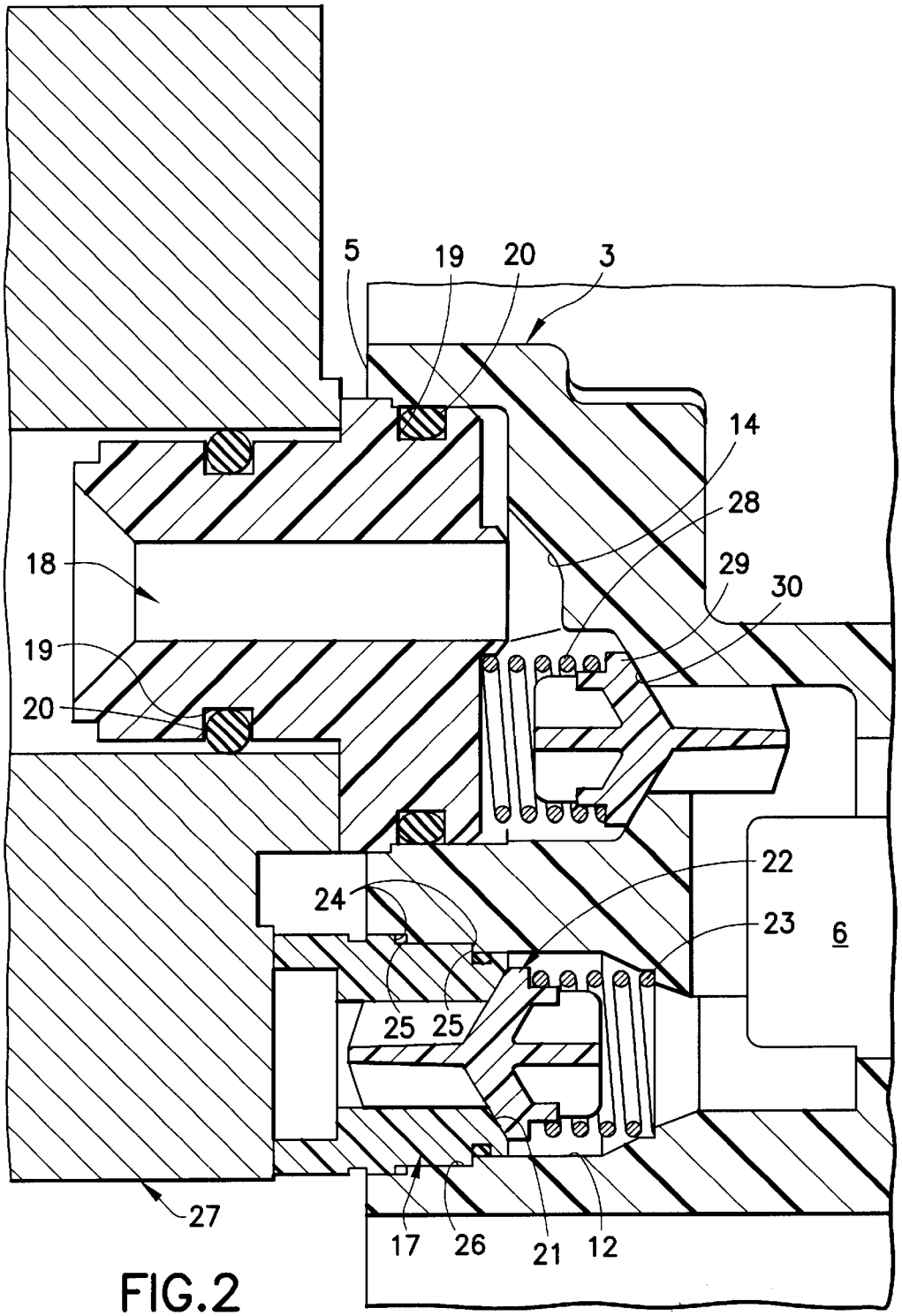
Figure 3:
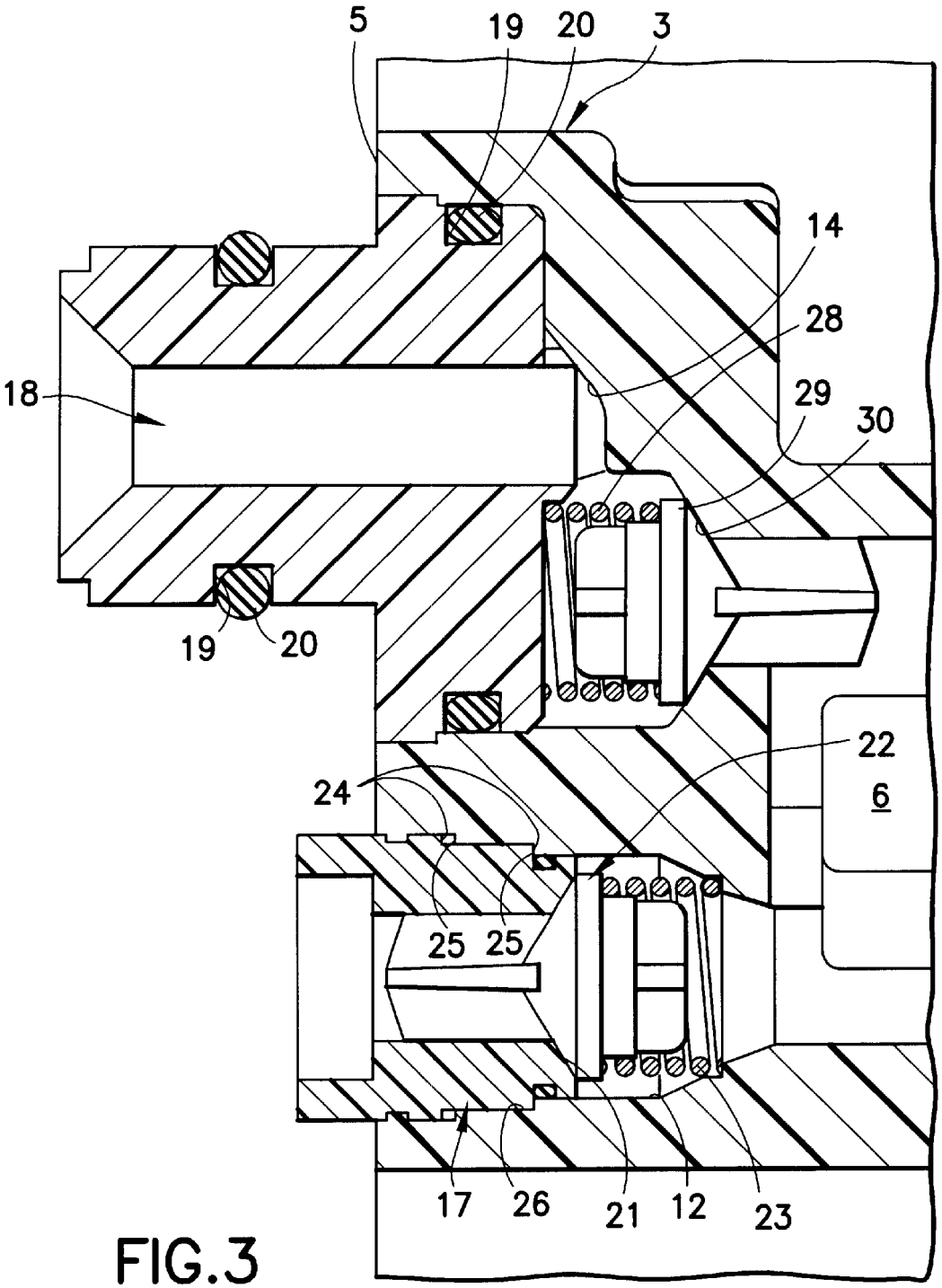
Figure 4:
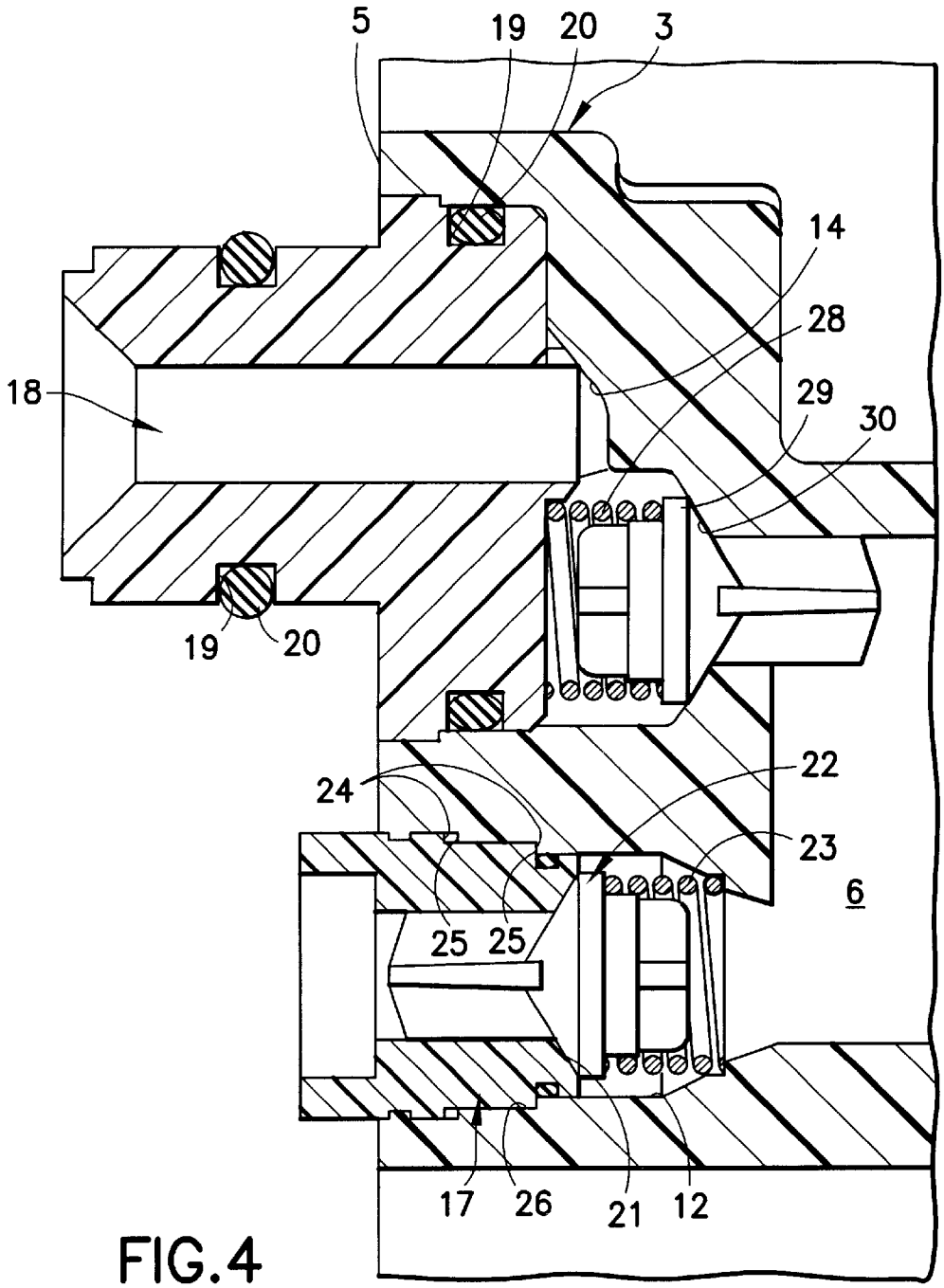

The following description of preferred embodiments of the invention will serve, in connection with the drawing, for a more detailed explanation. Therein FIG. 1 shows a longitudinal sectional view through a reciprocating pump for a high pressure cleaning appliance;

FIG. 2 an enlarged detailed sectional view of the pump block with an ultrasonic welding tool in place prior to carrying out the welding operation;

FIG. 3 a view similar to that of FIG. 2 but with the ultrasonic welding tool removed after the ultrasonic welding operation has been carried out.; and FIG. 4 shows an enlarged detailed sectional view of an alternate embodiment of the pump block, after the welding operation has been carried out.

The invention will be explained hereinafter using the example of a reciprocating pump in which there are disposed three mutually parallel pistons, said pistons being driven by a swash plate that is not illustrated in the drawing. However, it should be understood that the invention could also be made use of in differently constructed reciprocating pumps wherein the pump housing is sub-divided into two parts which abut one another along a interface.

The high pressure pump 1 illustrated in the drawing comprises a housing 2 incorporating a pump block 3 and a pump head 4. The pump block 3 and the pump head 4 abut one another along a flat interface 5 and are held tightly together by clamping means such as screws for example which are not illustrated in the drawing.

The pump block 3 accommodates pumping chambers 6 into which a respective cylindrical piston 7 projects, said piston 7 being sealed with respect to the pumping chamber 6 by means of suitable seals 8, 9, 10. The piston 7 is pushed into the pumping chamber 6 in oscillatory manner by a swash plate that is not illustrated in the drawing, and it is withdrawn therefrom by a surrounding coil spring 11 so that the volume of the pumping chamber 6 alters periodically.

The pumping chamber 6 is connected to a suction conduit 13 located in the pump head 4 via a connecting conduit 12 which passes through the interface 5. In like manner, a connecting conduit 14 is extended from the pumping chamber 6 through the interface 5 to a pressure conduit 15 in the pump head 4, and a high pressure conduit 16, through which the pumped cleaning medium is transported in known manner to a distributing device, a spray lance for example, is connected to said pressure conduit 15.

In the region of the interface 5, the connecting conduits 12 and 14 are mutually sealed by means of sleeve-like inserts 17, 18 which project into the respective connecting conduits 12 and 14 at each side of the interface 5 and hereby create a seal with respect to the surrounding wall, partially by means of O-ring seals 20 that are inserted into peripheral grooves 19.

Basically, the insert 17 in the connecting conduit 12 is a cylindrical sleeve whose rim 21 turned towards the pumping chamber 6 is in the form of a sealing seat for a longitudinally displaceable valve body 22 which is pressed against the rim 21 by means of a compression spring 23. This arrangement forms a suction valve for the pumping chamber 6.

The outer part of the sleeve-like insert 17 is provided with a plurality of steps or annular shoulders 24 which extend by a very small amount in the radial direction and correspond to the projecting annular shoulders 25 on the inner wall 26 of the connecting conduit 12.

When the insert 17 is pushed into the connecting conduit 12, the annular shoulders 24 and 25 abut one another and thereby prevent it from being fully inserted. Whilst in this position, an ultrasonic welding tool 27 is placed on that end face of the insert 17 projecting out from the pump block 3 and the ultrasonic energy applied therefrom simultaneously presses the insert 17 into the connecting conduit 12 and oscillates the insert 17 slightly relative to the surrounding inner wall 26. Due to this application of pressure and the simultaneously occurring periodic movement, the material in the zone of contact between the annular shoulders 24 and 25 becomes very hot and this heat causes the material in this zone of contact to melt. The melted materials of the annular shoulders 24 and 25 intermix and the insert 17 is gradually pushed deeper into the connecting conduit 12 by virtue of the axially directed advancing motion exerted by the ultrasonic welding tool 27 thereby resulting in the melted material of the inner wall 26 on the one hand, and that of the insert 17 on the other becoming thoroughly intermixed in the contact zone.

In this way, the insert 17 is pushed into the connecting conduit 12 by a certain amount, by 1 to 5 mm for example, and, over the length of this path, there thereby results a welded connection which, after the material has cooled, not only fixes the insert 17 securely in the connecting conduit 12 but also causes the insert 17 to be sealed on all sides with respect to the surrounding inner wall 26.

The state of the insert 17 prior to the welding process is illustrated in FIG. 2, whilst the state thereof following the ending of the welding process is illustrated in FIG. 3 and FIG. 4. The regions, in which the material of the insert on the one hand and that of the inner wall 26 on the other have intermixed so as to form a welded connection, are only illustrated very schematically therein, by showing either just the insert or just the inner wall. In reality, the materials are thoroughly intermixed in the contact zone and thereby appertain to both the insert and the inner wall.

FIG. 3 shows an embodiment of the present invention where the connecting conduit 12 penetrates the interface 5. In this embodiment, insert 17 is insertable into the connecting conduit 12 and is welded to the walls of the connecting conduit 12.

FIG. 4 shows an embodiment of the present invention where the pumping chamber 6 penetrates the interface 5. In this embodiment, insert 17 is insertable into the pumping chamber 6 and is welded to the walls of the pumping chamber 6.

The large axial forces exerted on the insert 17 by the valve body 22 are now directed exclusively into the inner wall 26 of the pump block 3 via this welded connection, whereas these axial forces are not applied to the pump head 4.

In like manner, the insert 18 is in the form of a sleeve-like connector which bridges the connecting conduit 14 in the region of the interface 5, and it is sealed with respect to the inner wall of the connecting conduit 14 both in the pump block 3 and in the pump head 4 by means of O-ring seals.

This insert 18 is pressed into the pump block end of the connecting conduit 14 and welded therein by an ultrasonic welding process in like-manner to insert 17. It would also be possible to dispense entirely with the O-ring seals at the pump block end of the insert 18 since a dependable seal already exists as a result of the welded connection.

In the embodiment illustrated, a compression spring 28, which pushes a valve body 29 against a sealing seat 30 at the pump block end, is supported on the end of the sleeve-like insert 18 facing the pumping chamber 6. This arrangement forms a pressure valve for the pumping chamber 6, and, in addition, this arrangement leads to a large axial force being applied to the sleeve-like insert 18. Such axial forces are also fed, in toto, into the pump block 3 through the welded connection, so that in this case too, no axial forces are conveyed to the pump head 4.

Overall then, the possibility is now provided of connecting the pump head 4 to the pump block 3 without the need for special axial security measures and the whole construction is considerably simplified. In particular, it is also possible thereby to connect the pump head 4 and the pump block 3 together by means of a welded connection, for example, the pump block 3 and the pump head 4 may each consist of a softenable synthetic material which can be bonded together in a manner similar to that used for connecting the inserts to the pump block.

In the embodiment that has been described and illustrated, the connection of the inserts to the pump block was effected by an ultrasonic welding process, but, in modified embodiments, this connection may be effected by other types of welding process, in particular, by butt welding, or by a vibratory welding or frictional welding process.

The connecting technique described is also applicable to other parts of the pump housing, for example, for fixing a valve insert 31 into a seating 32 on the pump head 4, this valve insert being fitted in a chemical draw-off conduit. This valve insert 31 consists, at least in the region where it touches the seating 32, of a softenable synthetic material in the same manner as the seating itself so that the two parts can be permanently connected together by means of a welded joint.

What is claimed is:

1. A reciprocating pump for a high pressure cleaning appliance including a pump housing in which there is disposed at least one pumping chamber having an inlet valve, an outlet valve and a reciprocating piston that projects into the pumping chamber, said piston being sealed with respect to said pumping chamber by one or more seals, said pump housing comprising a pump block and a pump head which abut closely together at an interface, wherein at least one of the pumping chambers and connecting conduits penetrate the interface and are sealed in the region of the interface by inserts that are insertable into said at least one of the pumping chambers and the connecting conduits from the interface, said inserts being fixed between the pump block and the pump head when in an inserted position, wherein the inserts themselves and the region of said at least one of the pumping chambers and the connecting conduits in which said inserts are accommodated consists of a thermally softenable synthetic material, and the inserts are connected to a wall of said at least one of the pumping chamber and the connecting conduit in which the inserts are accommodated by means of a welded joint.

2. A reciprocating pump in accordance with claim 1, wherein the pump block and the pump head consist of a thermally softenable synthetic material at least in the region of the interface and are connected together at the interface by a welded joint.

3. A reciprocating pump in accordance with claim 1, wherein the pump housing comprises a connector used for drawing-off a chemical and incorporating a valve insert which is seated in a seating of the pump housing, and the valve insert and the seating consist of a softenable synthetic material at least in their contact region and are connected together in this contact region by a welded joint.

4. A reciprocating pump in accordance with claim 2, wherein the pump housing comprises a connector used for drawing-off a chemical and incorporating a valve insert which is seated in a seating of the pump housing, and the valve insert and the seating consist of a softenable synthetic material at least in their contact region and are connected together in this contact region by a welded joint.

5. A reciprocating pump in accordance with claim 1, wherein the welded joint is an ultrasonically welded joint.

6. A reciprocating pump in accordance with claim 1, wherein the welded joint is formed by a vibratory welding process.

7. A reciprocating pump in accordance with claim 1, wherein the welded joint is formed by a frictional welding process.

8. A reciprocating pump in accordance with claim 1, wherein characterised in that the welded joint is a butt-welded joint.

9. A reciprocating pump in accordance with claim 2, wherein characterised in that the welded joint is an ultrasonically welded joint.

10. A reciprocating pump in accordance with claim 2, wherein characterised in that the welded joint is formed by a vibratory welding process.

11. A reciprocating pump in accordance with claim 2, wherein characterised in that the welded joint is formed by a frictional welding process.

12. A reciprocating pump in accordance with claim 2, wherein characterised in that the welded joint is a butt-welded joint.

13. A reciprocating pump in accordance with claim 1, wherein the insert is a sleeve.

14. A reciprocating pump in accordance with claim 13, wherein the rim of the sleeve remote from the interface is in the form of a sealing seat for a valve body.

15. A reciprocating pump in accordance with claim 13, wherein the sleeve is in the form of a sealing sleeve which projects beyond the interface.

16. A reciprocating pump in accordance with claim 1, wherein the insert serves as a support for a spring which pushes a valve body against a sealing seat.

17. A reciprocating pump in accordance with claim 1, wherein the insert and the pumping chamber or the connecting conduit accommodating it have annular shoulders which abut together when the insert is inserted and which, following the thermal softening of their material by the welding process, become deformed and bond together as the insert is inserted further.

18. A reciprocating pump in accordance with claim 2, wherein the insert and the pumping chamber or the connecting conduit accommodating it have annular shoulders which abut together when the insert is inserted and which, following the thermal softening of their material by the welding process, become deformed and bond together as the insert is inserted further.

* * * * *

UNITED STATES PATENT AND TRADEMARK OFFICE

CERTIFICATE OF CORRECTION

PATENT NO. : 6,428,291 B1
DATED : August 6, 2002
INVENTOR(S) : Baerlin et al.

It is certified that error appears in the above-identified patent and that said Letters Patent is hereby corrected as shown below:

Title page,
Item [30], Foreign Application Priority Data
"Apr. 14, 1998" is corrected to -- Jan. 14, 1998 --.

Signed and Sealed this

Twelfth Day of November, 2002

*Attest:*

*Attesting Officer*

JAMES E. ROGAN
*Director of the United States Patent and Trademark Office*